US005159796A

United States Patent [19]

Tas

[11] Patent Number: 5,159,796

[45] Date of Patent: Nov. 3, 1992

[54] APPARATUS FOR FILLING CONTAINER WITH PRODUCTS SUCH AS FRUITS

[76] Inventor: Adrianus W. Tas, Burg. Winkellan 3, 2631 HG Nootdorp, Netherlands

[21] Appl. No.: 720,295

[22] Filed: Jun. 28, 1991

[30] Foreign Application Priority Data

Jul. 2, 1990 [NL] Netherlands ..... 9001501

[51] Int. Cl.[5] ..... B65B 5/10

[52] U.S. Cl. ..... 53/245; 53/248

[58] Field of Search ..... 53/145, 245, 248, 260, 53/534, 535

[56] References Cited

U.S. PATENT DOCUMENTS

| | | | |
|---|---|---|---|
| 2,896,384 | 7/1959 | Carlsen et al. | 53/245 X |
| 3,269,083 | 8/1966 | Marano | 53/245 X |
| 3,420,038 | 1/1969 | Crabb | 53/245 X |
| 3,488,917 | 1/1970 | Oswald et al. | 53/245 |
| 4,062,168 | 12/1977 | Watts et al. | 53/245 X |
| 4,329,831 | 5/1982 | Warkentin et al. | 53/245 X |
| 4,600,065 | 7/1986 | Morris | 53/245 X |
| 4,608,808 | 9/1986 | Ryan et al. | 53/245 X |
| 4,875,327 | 10/1989 | Wilde | 53/245 X |

FOREIGN PATENT DOCUMENTS

| | | | |
|---|---|---|---|
| 0352841 | 1/1990 | European Pat. Off. . | |
| 2228673 | 12/1974 | France | 53/245 |
| 8801769 | 2/1990 | Netherlands . | |
| 600034 | 3/1978 | U.S.S.R. | 53/260 |

*Primary Examiner*—John Sipos
*Assistant Examiner*—Daniel B. Moon
*Attorney, Agent, or Firm*—Griffin, Branigan & Butler

[57] ABSTRACT

The invention relates to an apparatus for uniformly filling a container with products such as fruits or the like to a predetermined weight or level, in which apparatus the angular position of the container with respect to the horizontal is changed during filling in response to the instantaneous weight or level of the product in the container. According to the invention, a tongue which can be moved back and forth in substantially horizontal direction is provided below a product supply. The tongue assumes positions in response to the instantaneous weight or level of the product in the container such that the height of drop of the products into the container is kept at a minimal during filling and the container is filled uniformly.

12 Claims, 2 Drawing Sheets

APPARATUS FOR FILLING CONTAINER WITH PRODUCTS SUCH AS FRUITS

BACKGROUND OF THE INVENTION

The invention relates to an apparatus for uniformly filling a container with products such as fruits or the like up to a predetermined weight or level, in which apparatus the angular position of the container with respect to the horizontal is changed during filling in response to the instantaneous weight or level of the product in the container. By changing the angle of the container, the dropping distance from a product supply means into the container is decreased.

Such an apparatus is known from Netherlands patent application 88.01769 laid open to public inspection and the corresponding EP application 0.352.841. In that known apparatus, the products are supplied by means of a product supply conveyor belt that can be displaced in the horizontal direction: it has thus been attempted to effect a more uniform filling of the container by tilting the container with respect to the horizontal. This solution, however is not altogether satisfactory because in spite of the displacement of the belt, obstruction and arching of the product occurs at the point where the product passes from the belt into the container, and, moreover, an undesired height of drop of the product remains.

The object of the invention is to remove this drawback.

SUMMARY OF THE INVENTION

To that effect, the apparatus according to the invention has a "tongue" which can be moved in substantially the horizontal direction and is provided below the product supply means, e.g. said conveyor belt. The tongue assumes positions, depending on the instantaneous weight or level of the product in the container so that the height of drop of the product is kept at a minimum during filling and the container is filled more uniformly.

If the product supply means is a conveyor belt as mentioned above, the conveyor belt may be moved intermittently or slower. When the supply, during a predetermined subperiod of time, is too large, this prevents the obstruction or arching of the product where the product passes into the container.

Further, the conveyor belt may be moved intermittently or slower as the filling closely approaches the predetermined filling weight or level.

In a further elaboration of the invention, the product supply belt may be moved slightly backwards (in a direction away from the container) when the predetermined filling weight or level has been reached, so that an undesired discharge of excess product is prevented.

In a further elaboration of the invention, the movement of the tongue and the angular position of the container may be synchronized, e.g. by being coupled to each other. Such coupling can be realized by mechanical coupling, e.g. cams, cranks or eccentrics on a central drive, e.g. a shaft or electronically.

The container and the tongue movement, along with their drives, can be accommodated in an independent frame and collectively supported by a weighing device, such as a load cell or the like, which controls the angular position of the container and position of the tongue via a processor, e.g. a conventional computer. The independent frame with the weighing device may be supported by a basic frame on the ground via mechanical dampers, so as to prevent any harmful effects of external vibrations on the weighing device.

Further, a central shaft may be coupled to an angular position-measuring device (e.g. a pulse generator), which controls the position of the shaft for each angle of the container, depending on the instantaneous weight or level of the product in the container.

Also, an angular position-measuring device can be coupled to a central shaft, which controls the position of this shaft for each angle of the container, depending on the instantaneous weight or level of the product in the container. An output shaft of a drive may be coupled directly to the shaft that controls the movement of the container and the movement of the tongue.

For the sake of completeness, it is noted that apparatus for filling containers with products such as fruits are also known from U.S. Pat. Nos. 4,194,343 and 4,815,258. None of these two publications, however, discloses an apparatus fitted with a movable tongue, as in the present invention, which not only ensures a high degree of accuracy in filling to a predetermined weight or level, but also provides for minimum drop of the products into the container and a more uniform flat filling at the top of the container. The absence of flaps, such as used, for instance in the above-mentioned Netherlands patent application 88.01769, makes it possible for the filling process to be closely supervised during filling of the container.

It is further observed that the products are discharged one after the other, forming layers, as it were, so that a high degree of accuracy in filling up to the required total weight or level can be realized, and minimal drop of the product and a more uniform filling at the top of the container can be provided.

Thus, the invention involves an apparatus for uniformly filling a usual container, e.g. one having at least a rear wall and a bottom wall (and usually a front wall and side walls, e.g. a box, although other container configurations, such as a cylinder, may be used) with products such as fruit or the like to a predetermined weight or level of the product in the container. Such apparatus has a generally horizontal product supply means, e.g. a conveyor belt, disposed over the container for supplying and dropping the product into the container. The angle of the bottom wall of the container with respect to the horizontal is decreased during filling in response to the instantaneous weight or level of the product in the container, so as to decrease the dropping distance of the product.

In the present improvement, there is a generally horizontally-movable tongue disposed below the supply means and over the container and configured for receiving the product from the supply means and dropping the product into the container. A moving means is provided for generally horizontally moving the tongue in directions toward and away from said rear wall of the container. A control means is responsive to the instantaneous weight or level of product in the container and actuates the moving means to cause movement of the tongue to positions closer to the rear wall as the container is being filled and the angle of the bottom wall of the container is decreased.

With this arrangement, the height of drop of the products during filling from the supply means by way of the tongue to the bottom wall or the filled product in the container is minimized, and the container is uniformly filled.

To further explain the invention, some embodiments of the apparatus for uniformly filling a container with fruits will now be described, by way of example only, with reference to the accompanying drawings.

DESCRIPTION OF PREFERRED EMBODIMENTS

Figure 1:
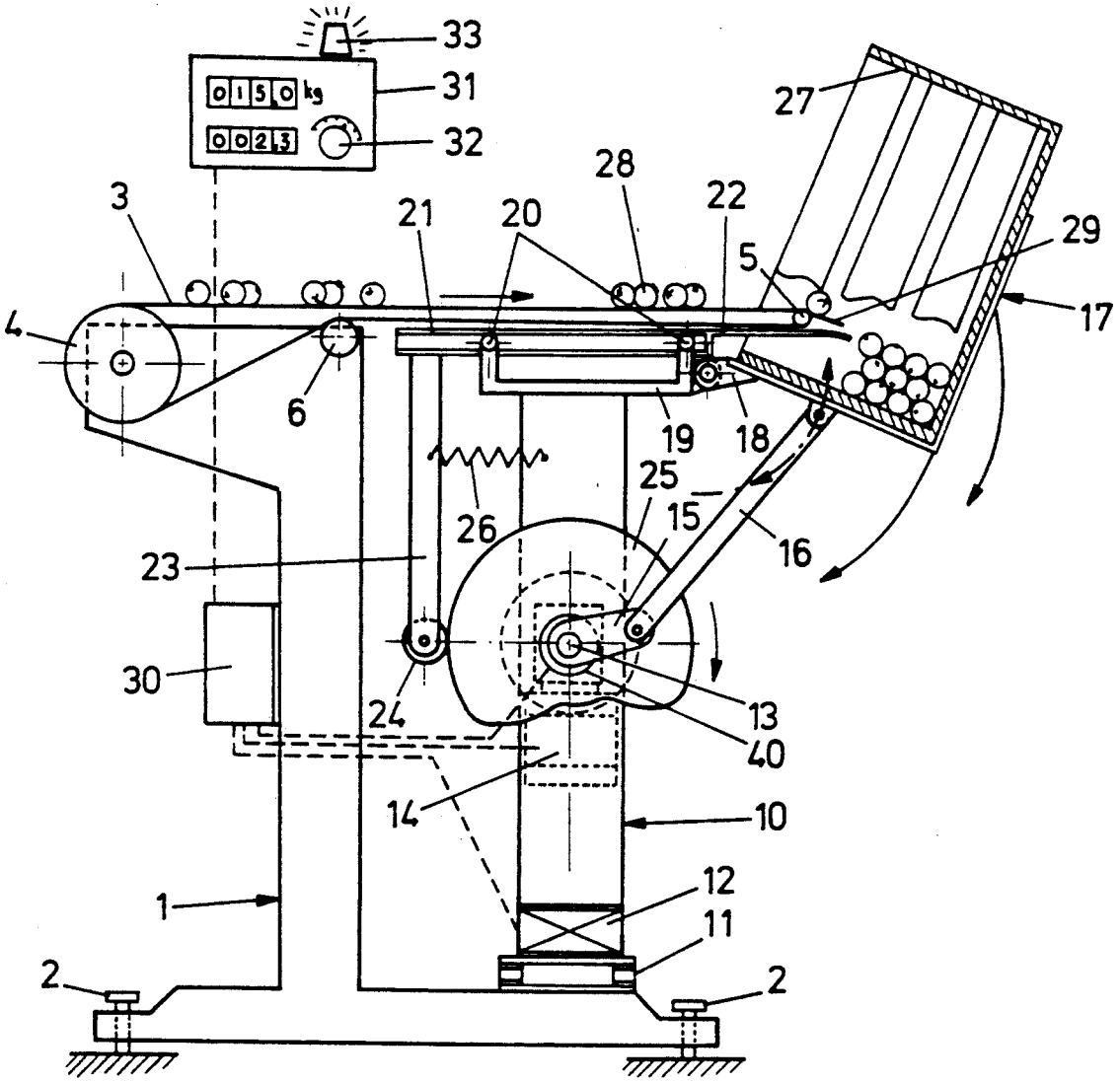
FIG. 1 is a diagrammatic side elevational view of an apparatus for uniformly filling a container with products such as apples.

Referring to the drawings, an apparatus for uniformly filling a container with products such as fruits comprises a frame 1 fitted with base adjusting members 2. Mounted on the frame 1 is a generally horizontal product supply means, e.g. an endless conveyor 3, which conveyor comprises two reversing rollers 4 and 5, one of which is driven, and a tensioning roller 6. Further, mounted on the frame 1 is an independent frame 10, with interposition of dampers 11. Arranged between the frame 10 and the damper 11 is a weighing device, e.g. a load cell 12. Mounted on the frame 10 is a central shaft 13, driven by motor 14.

Further, mounted on the central shaft 13 is a crank 15 having a transmission rod 16 connected to it, the free end of which is pivotally connected to a mounting plate 17 on which is mounted a usual fruit container 27, e.g. a box having front wall (to the left of the drawing), a rear wall (to the right of the drawing), side walls (shown in phantom lines), and a bottom wall (next to mounting plate 17).

The mounting plate 17 is further supported by a rod 18 whose free end is pivotally connected to a support table 19 mounted on the upper end of the frame 10.

Arranged at the top of support table 19 are rollers 20, which serve as guides for a slide 21. At its front end (to the left in the drawings), the slide 21 is driven by a lever 23, fixedly connected thereto, whose free end is fitted with a roller 24 cooperating with a cam disc 25 mounted on central shaft 13.

The roller 24 is at all times held in contact with cam disc 25 by means of a spring 26 arranged between the lever 23 and the frame 10. The means described are, therefore, moving means for generally moving the tongue 22 back and forth horizontally (in directions toward and away from the rear wall of the container), so that each product, in this case an apple 28, can be discharged at the desired location in the proper place in a container 27. To prevent damage to the products, a guide plate 29 is arranged at the discharge end of the conveyor belt 3 (the direction of travel is indicated by an arrow).

For proper control of the assembly, a control means is provided which is responsive to the instantaneous weight or level of the product in the container and for activating the moving means to cause movement of the tongue to positions closer to the rear wall of the container as it is being filled. Thus, there is mounted on frame 1 a processor 30, e.g. a computer, connected to a control panel 31, where, in addition to the instantaneous weight, the nominal total weight set can be read out. There is further provided a selector switch 32 for setting the selected container 27. As soon as the instantaneous weight has reached the nominal total weight, a signalling device 33 comes into operation.

The processor 30 is further connected to the load cell 12, the motor 14, and the angular position measuring device 40.

After the foregoing, the operation of the apparatus will be clear: the load cell 12 weighs the weight of the product in the container (after taring) and transmits this information to the processor 30. The processor regulates the position of the mounting plate 17, depending on the weight, and further determines, via the central shaft 13, the angular position of the cam disc 25 and, hence, the position of the tongue 22.

Figure 2:
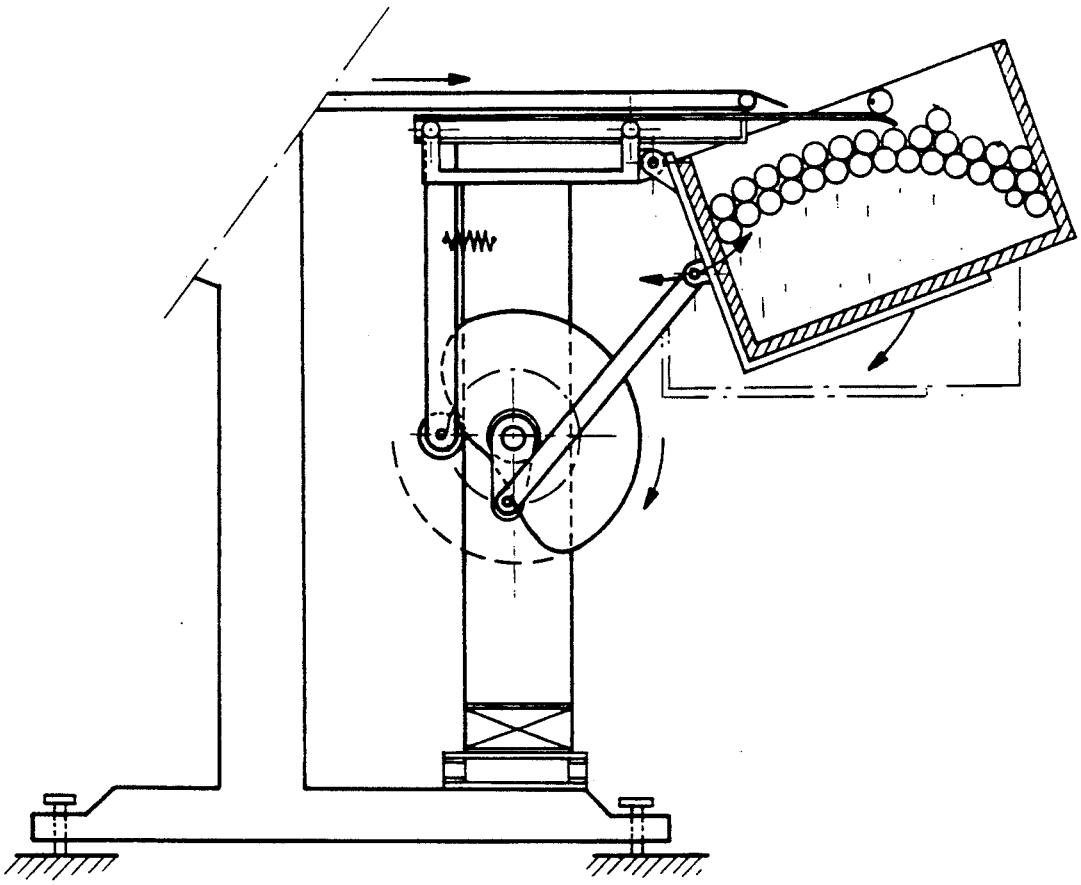
FIG. 2 shows a part of the elevation of FIG. 1, but with the components in a different position.

After the foregoing, FIG. 2 needs no further explanation.

Figure 3:
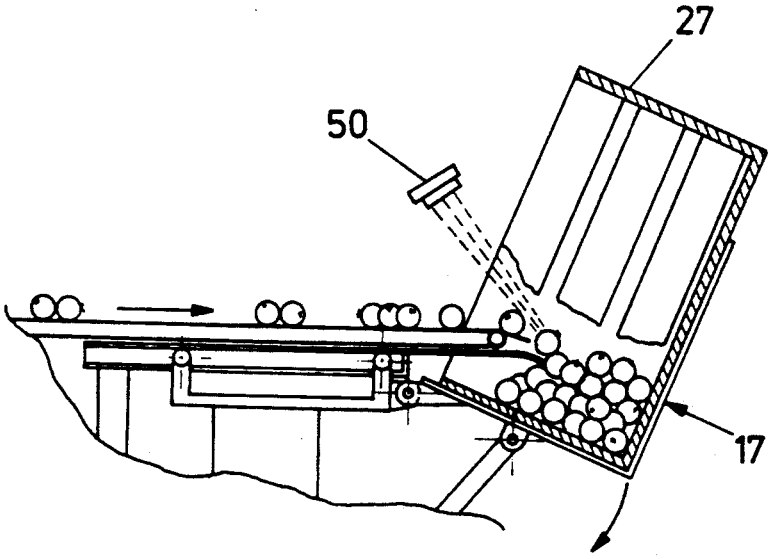
FIG. 3 is an elevation similar to FIG. 1 of a part of another embodiment of the apparatus for uniformly filling a container with products such as fruits.

In the embodiment shown in FIG. 3, the control of the position of the mounting plate 17 is not effected by the weight measured, but by means of an optical device 50 oriented towards the discharge end of the guide plate 29. The optical device may, for instance, consist of a transmitter/receiver which measures the level of the products in the container 27 by means of reflection. It will be clear, however, that other systems can be used as well. It is noted that filling may be done completely optically, but it is also possible to check the final weight by means of a weighing cell or the like, so that it is ensured that the amount of product delivered has the proper weight.

What is claimed is:

1. In an apparatus for uniformly filling a container having at least a front wall, a rear wall and a bottom wall with rollable products such as fruit to a predetermined weight or level of the product in the container, wherein a generally horizontal product supply means is disposed over the container for supplying and dropping the product into the container and the angle of the bottom wall with respect to the horizontal is decreased during filling in response to the instantaneous weight or level of the product in the container, the improvement comprising:

(1) a generally horizontal movable tongue disposed at least in part below and generally parallel to said supply means and at least in part over said front wall of said container and configured for receiving the rollable products from the supply means, rolling the products to an edge thereof and dropping the product into the container;

(2) moving means for generally horizontally moving the tongue in a single direction toward said rear wall during a filling of a container and in an opposite direction away from said rear wall after the container has been filled;

(3) control means responsive to the instantaneous weight or level of product in the container for actuating the moving means and causing movement of the tongue to positions closer to said rear wall as the container is being filled and the angle of the bottom wall of the container with respect to the horizontal is decreased; and wherein a height of drop of the products during filling thereof from the supply means by way of the tongue to the bottom wall or the filled product in the container is minimized and the container is uniformly filled.

2. An apparatus according to claim 1, wherein the product supply means is a flat belt which is adapted to move intermittently, thereby preventing bunching of the product in dropping from the tongue to the container.

3. An apparatus according to claim 1, wherein the product supply means is a flat belt which is adapted to move intermittently when the total weight or level of the product in the container approaches the predetermined weight or level, so that an accurate filling of the container is achieved.

4. An apparatus according to claim 1, wherein the product supply means moves slightly backwards when the predetermined weight or level of product in the container has been reached, so that further discharge of product into the container is prevented.

5. An apparatus according to claim 1, wherein the movement of the tongue and the angular positions of the bottom wall of the container with respect to the horizontal are coupled.

6. An apparatus according to claim 5, wherein said coupling is by mechanical couplings.

7. An apparatus according to claim 1, wherein there are container moving means and the container moving means and the moving means for moving the tongue are in an independent frame which is supported by a weighing device that controls the position of the container and the position of the tongue via a processor.

8. An apparatus according to claim 7, wherein the independent frame with the weighing device is supported by a basic frame on the ground via dampers so as to prevent harmful effects of external vibrations on the weighing device.

9. An apparatus according to claim 7, wherein an angular position-measuring device is coupled to a central shaft for causing movement of the tongue and the container, which measuring device controls the angular position of the shaft in response to the instantaneous weight or level of the product in the container as determined by the weighing device.

10. An apparatus according to claim 7, wherein a crank is coupled directly to a central shaft causing movement of the container and movement of the tongue.

11. An apparatus according to claim 1, wherein the product supply means is a flat belt which is adapted to be decreased in speed, thereby preventing bunching of the product in dropping from the tongue to the container.

12. An apparatus according to claim 1, wherein the supply means is a flat belt which is adapted to be decreased in speed when the total weight or level of the product in the container approaches the predetermined weight or level, so that accurate filling of the container is achieved.

* * * * *